United States Patent [19]

Takenobu

[11] Patent Number: 4,609,848

[45] Date of Patent: Sep. 2, 1986

[54] COLOR CATHODE-RAY TUBE WITH INSULATING ROD SUPPORT FOR ELECTRON GUN

[75] Inventor: Shinya Takenobu, Nagaokakyo, Japan

[73] Assignee: Mitsubishi Denki Kabushiki Kaisha, Tokyo, Japan

[21] Appl. No.: 662,452

[22] Filed: Oct. 17, 1984

[30] Foreign Application Priority Data

Dec. 20, 1983 [JP] Japan ..... 58-197380[U]

[51] Int. Cl.[4] ..... H01J 29/82; H01J 29/50

[52] U.S. Cl. ..... 313/417; 313/457; 313/482

[58] Field of Search ..... 313/457, 451, 417, 482

[56] References Cited

U.S. PATENT DOCUMENTS 2,761,990 9/1956 Amdursky et al. ..... 313/417

2,950,406 8/1960 Barnett et al. ..... 313/417 X 4,009,411 2/1977 Puhak ..... 313/417 X 4,207,493 6/1980 Forster ..... 313/479 X 4,258,284 3/1981 Month et al. ..... 313/390

FOREIGN PATENT DOCUMENTS 158858 12/1979 Japan ..... 313/451

*Primary Examiner*—Palmer C. DeMeo

*Attorney, Agent, or Firm*—Lowe Price Leblanc Becker & Shur

[57] ABSTRACT

A color cathode-ray tube according to the present invention includes an electron gun, in the neck portion thereof, aligned with the central axis of the neck portion of the cathode-ray tube by support members connected to the rear end portion of the electron gun to be in contact with the inner surface of the neck portion in addition to contactors connected to the front end portion of the electron gun.

1 Claim, 6 Drawing Figures

COLOR CATHODE-RAY TUBE WITH INSULATING ROD SUPPORT FOR ELECTRON GUN

BACKGROUND OF THE INVENTION

1. Field of the Invention

The present invention relates to a color cathode-ray tube, and more particularly, it relates to an improvement in a device for supporting an electron gun in the color cathode-ray tube.

2. Description of the Prior Art

As shown in FIG. 1, a color cathode-ray tube 1 generally comprises a panel portion 2, a funnel portion 3 and a neck portion 4.

The panel portion 2 is provided with a mosaic fluorescent screen 2*a* formed by luminescent materials for three primary colors of red, green and blue, and a shadow mask 5 serving as a color selecting means.

The neck portion 4 comprises an electron gun 6 for emitting electron beams 7. The funnel portion 3 connects the panel portion 2 and the neck portion 4 to define a vacuum vessel, and a deflector yoke 8 is externally mounted in the transition region between the funnel and neck portions.

The in-line type of electron gun 6 provided in the neck portion 4 is shown in detail in FIG. 2.

Referring to FIG. 2, a cathode 9, a first grid electrode 10, a second grid electrode 11, a focusing electrode 12 and a high-voltage electrode 13 are supported by rod-shaped support members 19, made of an electrically insulating material such as glass.

Provided in the front portion of the electron gun 6 is a cylindrical shield coupling 14, which is provided projectingly on its outer periphery with elastic contactors 15 to be in electrical contact with a conductive coating (not shown) coated over the inner surfaces of the transition region between the funnel and neck portions. A stem 16 supports inner leads 18 and outer leads 17. In this case, the stem 16 is mounted to a mount pin provided in the central portion of a sealing jig (not shown), whereby the electron gun 6 is retained concentrically with respect to the neck portion 4, the right end portion of which in FIG. 2 is welded by a flame from a gas burner to the outer periphery of the stem 16 to seal the same.

The electron gun 6 thus inserted in the neck portion 4 is retained, as a whole, in a concentric manner with respect to the neck portion 4, with the contactors 15 being in contact with the inner surface of the neck portion and the rear end of the gun being concentrically supported through the stem 16. In this case, good dynamic beam convergence is attained on condition that the center of the electron beam 7 as shown in FIG. 1 is aligned with that of the deflector yoke 8. The center of the electron beam 7 can be brought into alignment with that of the deflector yoke 8 by setting the beam in coincidence with the central axis of the funnel portion 3, since the deflector yoke is substantially coaxial with the funnel portion.

Determination as to whether the electron beam 7 is emitted in coincidence with the central axis of the funnel portion 3 depends on whether the electron beam reaches the central point of the panel portion 2 in a non-deflected state. Therefore, the electron gun 6 must be so improved in accuracy that the central axis thereof will be set in coincidence with that of the neck portion 4 for minimizing deviation of the electron beam 7 from the aforementioned central point of the panel portion 2.

In general, the concentricity at the front end of the electron gun 6 is obtained and retained by the contactors 15 mounted to the shield coupling 14 while that at the rear end of the gun is obtained through the stem 16 concentrically fixed to the neck portion 4 as hereinabove described, as shown in FIG. 2.

Although, in such a system, the electron gun 6 can be regarded as a substantially rigid unit including the cathode 9, the inner leads 18 provided rearwardly of the cathode 9 do not provide satisfactory rigidity. Therefore, even if the electron gun 6 is set for concentricity through the stem 16 at its rear end, the rear portion thereof, particularly the central hole (not shown) of the first grid electrode 10 is not securely prevented from deviating from the central axis of the neck portion 4.

Thus, since the electron gun 6 is secured in concentricity with the neck portion 4 at its front end but tends to deviate from the concentricity at its rear portion, the gun as a whole tends to deviate from the coaxial position with respect to the neck portion. Upon such deviation, therefore, the electron beam 7 as shown in FIG. 1 deviates from the center of the panel portion 2, whereby good dynamic convergence cannot be attained.

Although it is certainly possible to increase the rigidity of the inner leads 18 as shown in FIG. 2 for solving the aforementioned problem, such rigid inner leads 18 may cause a local high stress and thus crack the fragile stem 16 of glass.

SUMMARY OF THE INVENTION

The present invention overcomes the aforementioned disadvantage of the prior art, and aims at providing a color cathode-ray tube in which the central axis of an electron gun is effectively aligned with that of a neck portion, whereby excellent dynamic beam convergence can be obtained.

A color cathode-ray tube in accordance with the present invention comprises a vacuum vessel constituted of a panel portion provided in its inner surface with a fluorescent screen, a funnel portion and a neck portion and an electron gun provided in said neck portion, said electron gun being provided at longitudinally different plural positions thereof respectively with supporting means to be in contact with the inner surface of said neck portion for setting the central axis of said electron gun in coincidence with the central axis of said neck portion.

The above and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention is hereinafter described with reference to the accompanying drawings.

Figure 1:
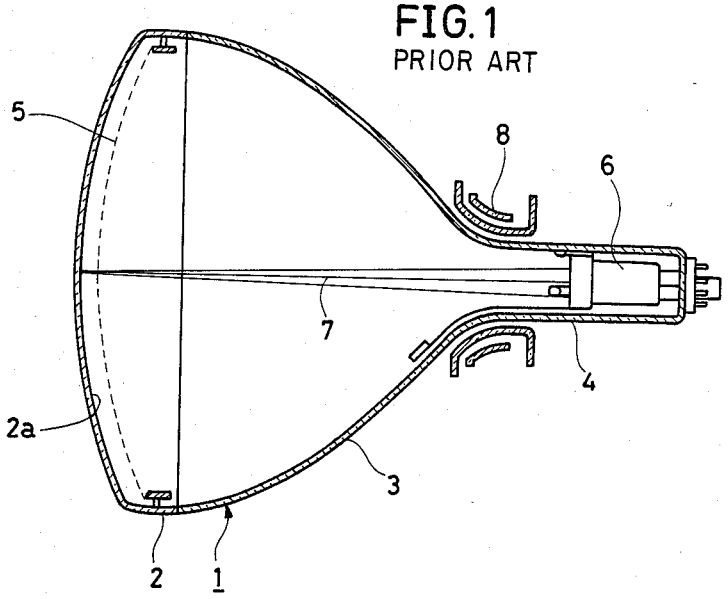
FIG. 1 PRIOR ART
FIG. 1 is a sectional view showing the structure of a conventional color cathode-ray tube as a whole.
Figure 2:
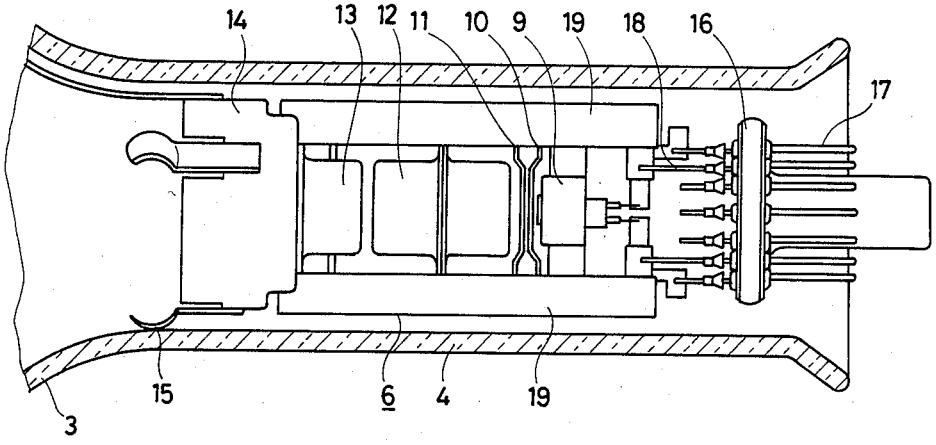
FIG. 2 PRIOR ART
FIG. 2 is an enlarged sectional view of the neck portion of the tube in FIG. 1, showing a support system for a conventional electron gun.
Figure 3:
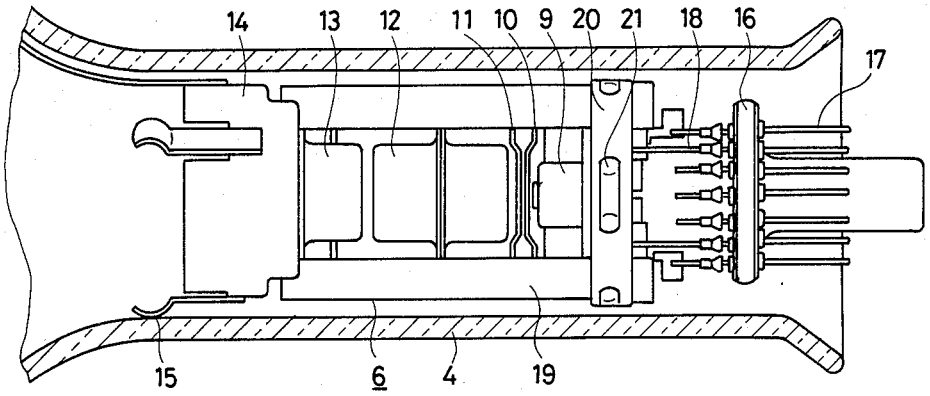
FIG. 3 is a sectional view similar to FIG. 2, but showing an embodiment of the present invention.
Figure 4:
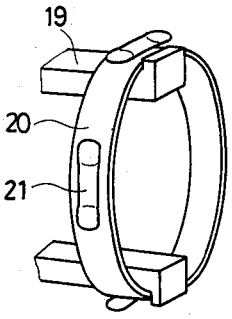
FIG. 4 is a perspective view showing an array of mounted bulb spacers.

Although the substantial components in FIG. 2 are included in FIG. 3, the electron gun 6 in FIG. 3 is provided in addition to the contactors 15 with bulb spacers 21 in the rear portion to be in contact with the inner surface of the neck portion 4 for making the central axis of the gun aligned with that of the neck portion. As shown in FIG. 4, each of the bulb spacers 21 provided projectingly is fixed at the center thereof to the outer peripheral surface of a mounting ring 20 which is engaged with the outer side of the insulator support member 19, and is formed by an elastic material so that both the free ends thereof can be brought into contact with the inner surface of the neck portion 4.

With such structure, the electron gun 6 is, as shown in FIG. 3, supported not only at its front end by the contactors 15 but also at its rear end by the bulb spacers 21 concentrically with the neck portion 4, whereby the gun is aligned coaxially with the neck portion. Since the electron gun 6 is thus satisfactorily supported without causing any cracks in the stem 16, the electron beam emitted therefrom effectively reaches the central point of the panel portion 2 whereby an excellent dynamic convergence can be obtained.

Figure 6:
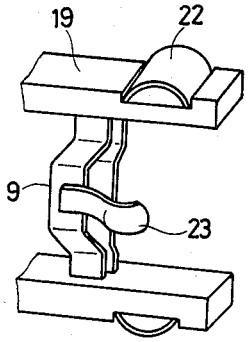
FIG. 6 is a perspective view showing a set of bulb spacers for mounting as shown in FIG. 5.
Figure 5:
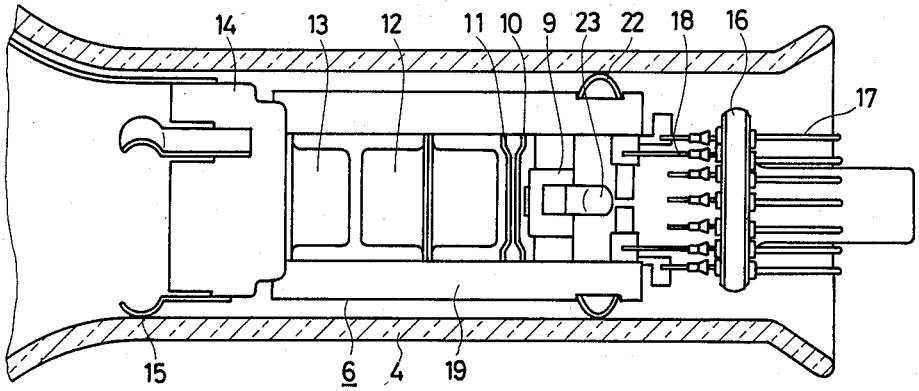
FIG. 5 is a sectional view similar to FIG. 3, but showing another embodiment of the present invention.

Although insulation between the mounting ring 20 and lead wires for connecting the respective electrodes with the inner leads 18 in the embodiment as shown in FIG. 3 must be contrived to some extent, such contrivance in the insulation is not required if the respective insulator support members 19 are provided with grooves to be engaged with bulb spacers 22 of arched elastic plates as shown in FIG. 5, with another bulb spacer 23 being provided projectingly on the convex side of the cathode 9 as shown in FIG. 6.

Although the present invention has been described and illustrated in detail, it is clearly understood that the same is by way of illustration and example only and is not to be taken by way of limitation, the spirit and scope of the present invention being limited only by the terms of the appended claim.

What is claimed is:

1. A color cathode-ray tube comprising a vacuum vessel constituted of a panel portion provided in its inner surface with a fluorescent screen, a funnel portion and a neck portion provided with an internal conductive coating and an electron gun containing a plurality of electrodes provided in said neck portion, said electron gun being provided at longitudinally different plural positions thereof respectively with supporting means for supporting the central axis of said electron gun in coincidence with the central axis of said neck portion, said plural supporting means comprising:

a first supporting means, provided in the front portion of said electron gun, comprising contactors to be in contact with said conductive coating adjacent the transition between said funnel and neck portions;

a plurality of externally grooved insulator rods arranged on the exteriors of said electrodes to support said electrodes, including a cathode electrode, of said electron gun; and a second supporting means provided in the rear portion of said electron gun, disposed to project outwardly of said insulator rods in engagement with said grooves of said insulator rods.

* * * * *